US005899104A

United States Patent [19]

Brilman et al.

[11] Patent Number: 5,899,104

[45] Date of Patent: May 4, 1999

[54] METHOD AND APPARATUS FOR SHAPING A CAN

[75] Inventors: Gerrit Willem Brilman, Bathmen; Johan Willem Roeterdink, Epse, both of Netherlands

[73] Assignee: Thomassen & Drijver-Verblifa B.V., Deventer, Netherlands

[21] Appl. No.: 08/894,299

[22] PCT Filed: Feb. 16, 1996

[86] PCT No.: PCT/NL96/00072

§ 371 Date: Oct. 22, 1997

§ 102(e) Date: Oct. 22, 1997

[87] PCT Pub. No.: WO96/25256

PCT Pub. Date: Aug. 22, 1996

[30] Foreign Application Priority Data

Feb. 16, 1995 [NL] Netherlands ..... 9500289

[51] Int. Cl.[6] ..... B21D 26/02; B21D 51/26

[52] U.S. Cl. ..... 72/58; 72/57

[58] Field of Search ..... 72/57, 58, 60

[56] References Cited

U.S. PATENT DOCUMENTS

| | | | |
|---|---|---|---|
| 3,564,884 | 2/1971 | Hinshaw | 72/57 |
| 3,611,768 | 10/1971 | Odagaki | 72/58 |
| 3,698,337 | 10/1972 | Brawner et al. | 72/58 |
| 4,580,427 | 4/1986 | Akamatsu | 72/62 |
| 4,722,216 | 2/1988 | Fencl | 72/402 |
| 5,097,689 | 3/1992 | Pietrobon | 72/58 |

FOREIGN PATENT DOCUMENTS

| | | |
|---|---|---|
| 675303 | 7/1966 | Belgium . |
| 0492860 | 7/1992 | European Pat. Off. . |
| 0543695 | 5/1993 | European Pat. Off. . |
| 3716176 | 9/1988 | Germany . |

OTHER PUBLICATIONS

Patent Abstracts of Japan, vol. 009, No. 235 for Japanese Publication No. JP60092028, Publication date May 23, 1985, 1 page.

Patent Abstracts of Japan, vol. 010, No. 388 for Japanese Publication No. JP61176433, Publication date Aug. 8, 1986, 1 page.

*Primary Examiner*—David Jones

*Attorney, Agent, or Firm*—Webb Ziesenheim Logsdon Orkin & Hanson, P.C.

[57] ABSTRACT

A method for shaping a metal can comprising a substantially cylindrical body and a bottom such that the body acquires a cross-sectional form varying with the axial position comprises the steps of: (1) providing said can; (2) exerting substantially radial forces on the body in the direction of the desired shaping; and (3) exerting a substantially axial force on the body simultaneously with step (2).

17 Claims, 4 Drawing Sheets

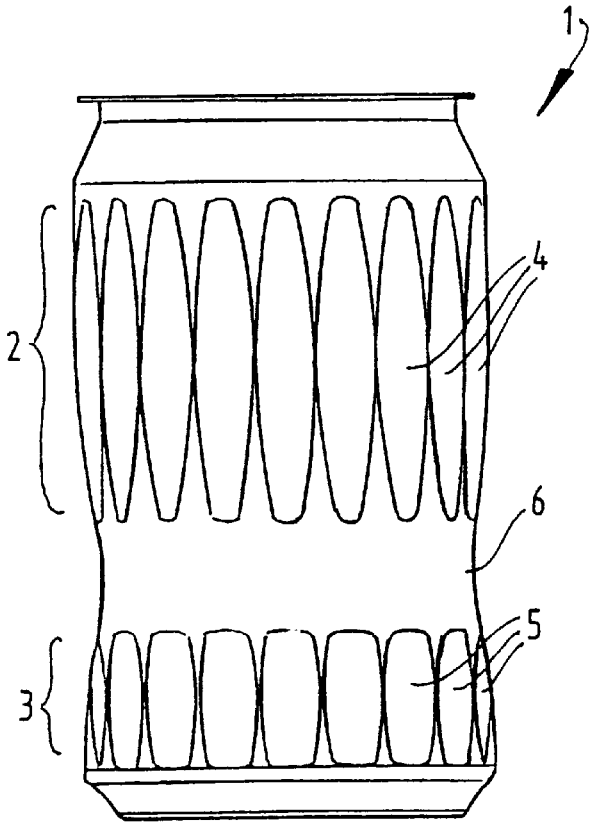
FIG.1
FIG.9
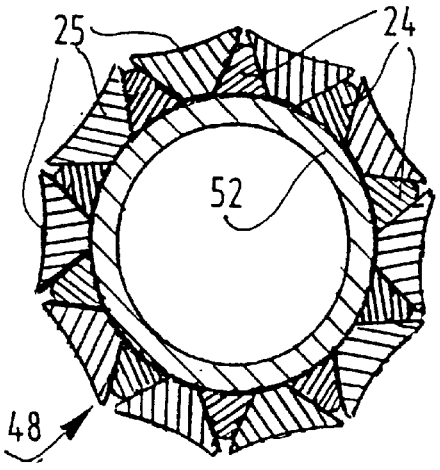
FIG.10
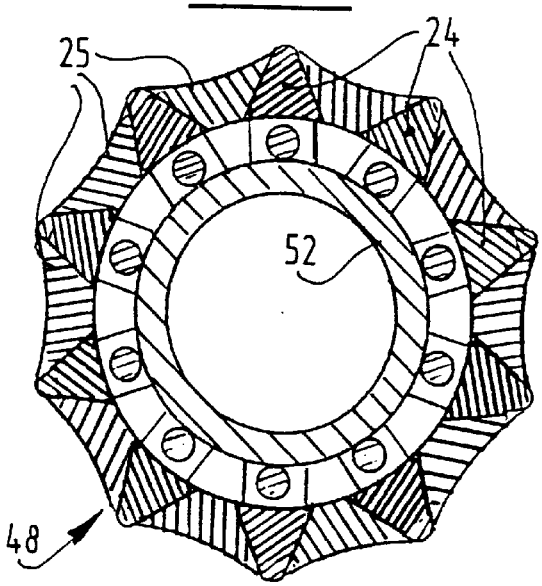

METHOD AND APPARATUS FOR SHAPING A CAN

BACKGROUND OF THE INVENTION

Metal cans are known in many embodiments. It is an object of the invention to shape a metal can, consisting substantially for instance of tin or aluminium which may or may not be provided with coatings consisting of lacquer, printing ink or the like, such that a desired form is obtained, wherein the cross-sectional form varies with the axial position.

It has been found in experiments that it is not possible to obtain desired body forms by only applying substantially radial forces to a can. Due to the stresses which occur the shaping process is very difficult to control and there is the danger of the body collapsing.

In respect of the above the invention provides a method for shaping a metal can comprising a substantially cylindrical body and a bottom such that the body acquires a cross-sectional form varying with the axial position, which method comprises the steps of:

(1) providing said can;

(2) exerting substantially radial forces on the body in the direction of the desired shaping; and (3) exerting a substantially axial force on the body simultaneously with step (2).

Surprisingly, it has been found that by simultaneously exerting the forces acting in radial direction and exerting axial forces, the ability to shape the metal is improved considerably, whereby desired can shapes can be realized which correspond to comparatively high percentages of deformation.

With respect to the radial forces it is noted that in order to obtain a locally smaller diameter the radial forces must be exerted inwardly. When such a force is applied the can has a natural tendency to elongate. The axial auxiliary force in accordance with step (3) can be applied to the outside (tensile force) as well as to the inside (pressure force). It is also possible to start with a relatively small can which is subjected to locally outward directed radial forces. The can hereby has a natural tendency to become shorter. Also in this case the axial auxiliary force can be directed to the outside as well as to the inside.

In order to exert the said radial forces use can be made of mechanical means such as segmented pressure rings with variable diameter or a rubber press or pressure medium, for instance gas or liquid under pressure.

In order to exert radial pressure forces use can be made of simple pressing punches. To exert axial tensile forces a pressure force can be exerted on the bottom via the mouth of the can in combination with a tensile force which is applied by an annular claw on the edge zone of the mouth opening.

Particularly in the case where the desired final shape of a can displays a specific profiling, for instance a plurality of recesses, ribs, flat facets or the like, the method according to the invention can be performed such that the radial forces press a can body toward and against a shaping wall, which wall has a shape corresponding with the desired final shape of the can body.

SUMMARY OF THE INVENTION

The invention also relates to an apparatus for performing a method as specified above for shaping a metal can comprising a substantially cylindrical body and a bottom such that the body acquires a cross-sectional form varying with the axial position, which apparatus comprises;

positioning means for positioning a can;

first means for exerting substantially radial forces on the body of a positioned can in the direction of the desired shaping; and second means for exerting a substantially axial force on the can body simultaneously with the action of the first means.

The invention also relates to a metal can obtained by applying a method as specified above.

BRIEF DESCRIPTION OF THE DRAWINGS

The invention is elucidated with reference to the annexed drawings wherein:

FIG. 1 shows a side view of an embodiment of the invention;

FIGS. 9 and 10 show cross sections through the pressure segments according to FIGS. 7 and 8 in respectively the retracted and the expanded situation.

The can 1 according to FIG. 1 has two annular groupings 2, 3 of respective facets 4, 5 and a constriction 6 therebetween, i.e. a zone of reduced diameter.

FIGS. 2, 3, 4, 5 and 6 show very schematically five different apparatuses for shaping a metal starting can.

DESCRIPTION OF THE PREFERRED EMBODIMENTS

Figure 2:
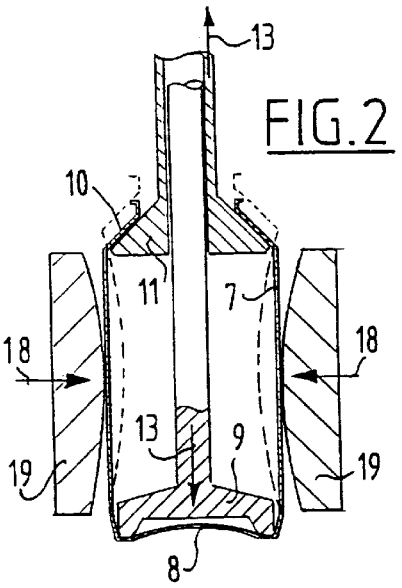
FIGS. 2, 3, 4, 5, 6 show schematic cross sections of apparatus for performing the method according to the invention.
Figure 3:
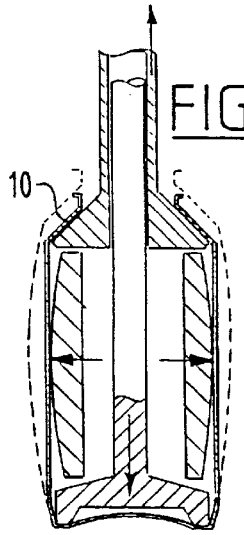
Figure 6:
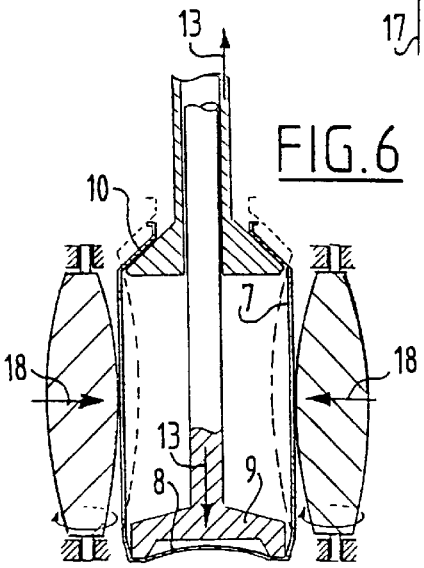

In the embodiments of FIGS. 2, 3 and 6 the can is subjected to an axial tensile force by making use of a punch 9 pressing from the inside against the can bottom 8 and a second punch 11 pressing from the inside against the mouth edge 10. It is noted that the drawn configuration is of course schematic inasfar as the punches must be capable of passing through the mouth opening 12 of can 7. This can be realized by making use of segmented expandable punches. Arrows 13 indicate the relevant tensile force. As a consequence of the engagement by punch 9 on the edges of bottom 8 and the corresponding engagement by the second punch 11 on the mouth edge 10 an axial tensile force is exerted in the can body 14 without this being accompanied by deformation of other can parts.

Figure 4:
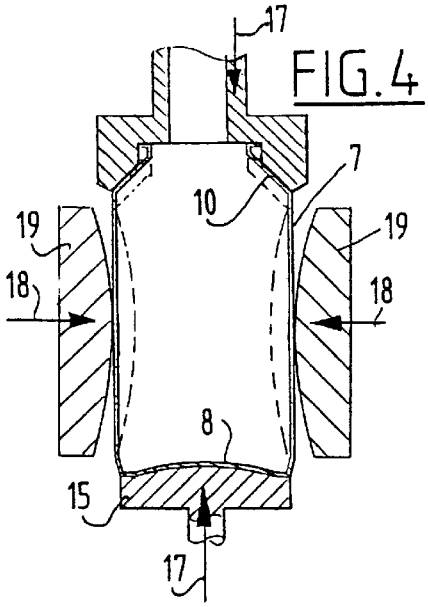
Figure 5:
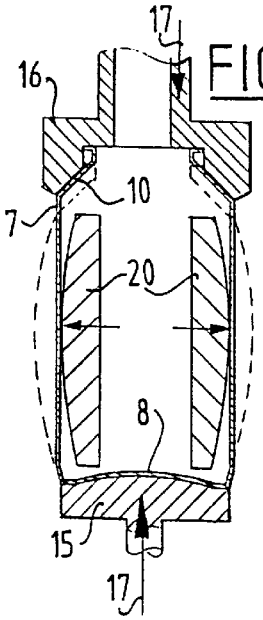

In the variants according to FIGS. 4 and 5 not a tensile force but a pressure force is applied to the can body 14. Use is made for this purpose of a third punch 15 pressing against the bottom and a fourth punch 16 pressing against the mouth edge 10. The pressure force is indicated symbolically with arrows 17.

In the variants according to FIGS. 2 and 4 use is made of inward directed forces 18 which are exerted by a ring of pressure segments 19. These latter are movable inward from outside.

FIGS. 3 and 5 show variants in which a ring of pressure segments 20 is expandable outward.

FIG. 6 shows an embodiment which displays similarity to the embodiment of FIG. 2. In the embodiment of FIG. 6, however, use is made of at least two rollers which each have a rotation symmetrical form and can exert an inward directed rolling pressure force on the correspondingly rotating can 7.

In FIGS. 2, 3, 4, 5, 6 the respective final shapes of the can 7 are shown in dashed lines. Attention is drawn to the fact that the bottom 8 remains undeformed. The same is the case for the mouth edge 10. However, these can optionally be subjected to a certain axial displacement, although this is not necessary in all conditions.

Figure 7:
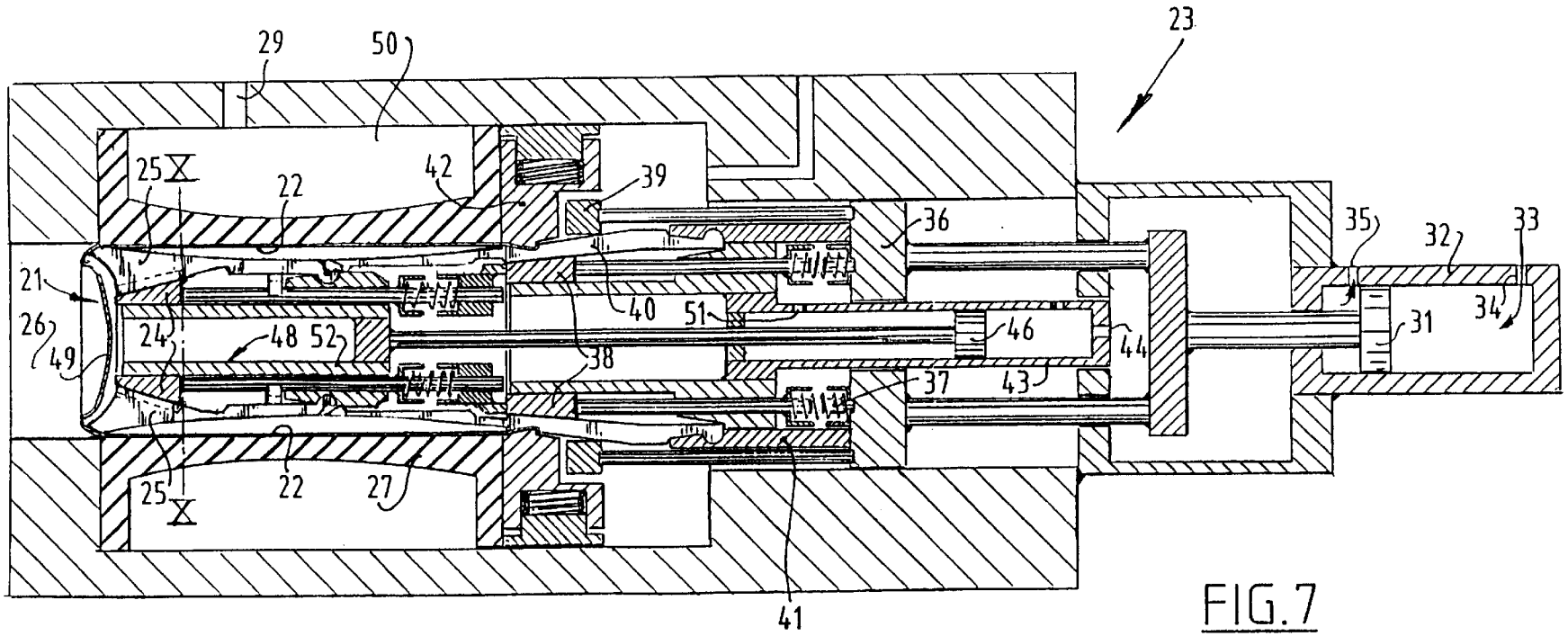
FIGS. 7 and 8 show cross sections through an apparatus according to the invention in two successive operating stages.
Figure 8:
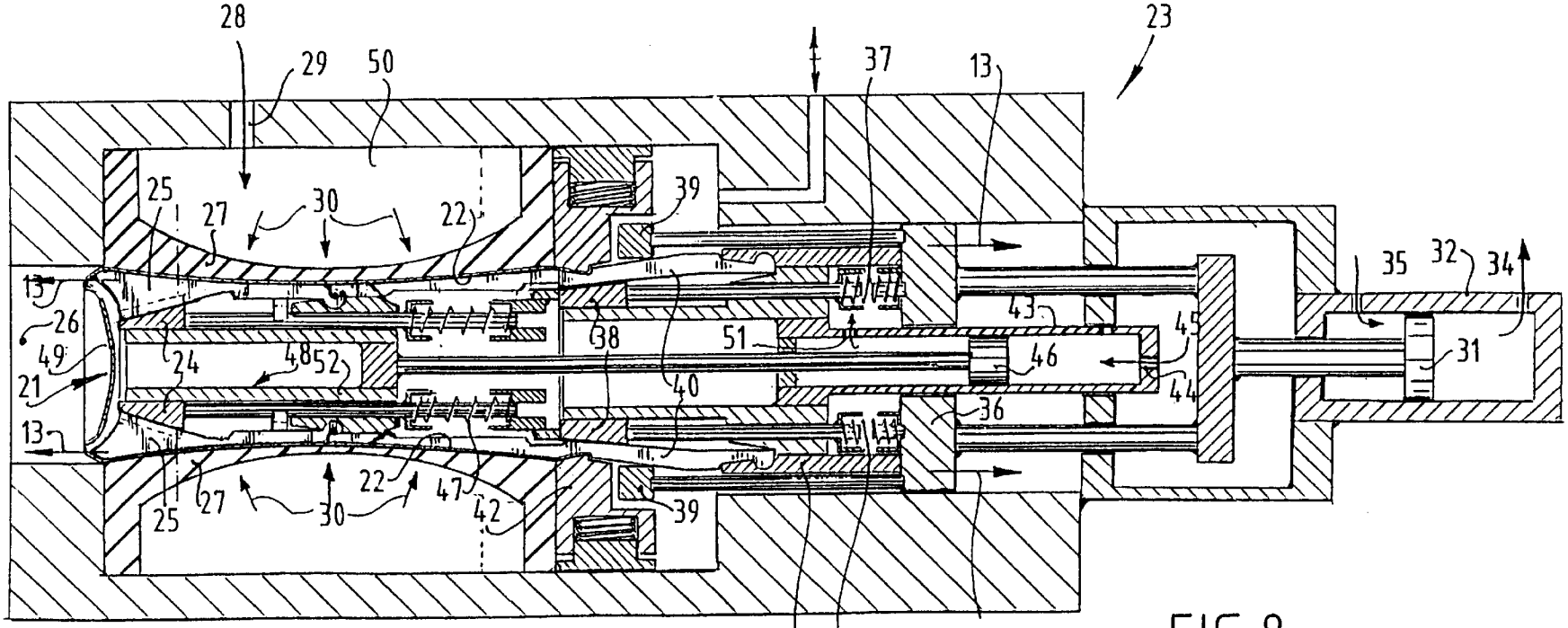

FIGS. 7 and 8 show an apparatus 23 according to the invention. The principle of this apparatus 23 corresponds with that according to FIG. 2. The apparatus 23 is adapted to shape a can 21 comprising a body 22. A pressure force directed axially outward is applied to the bottom 49 on the peripheral edge thereof as according to arrows 13. Use is made for this purpose of outward expandable segments 24, 25 of the can (see also the description of FIGS. 9 and 10). The mouth edge 10 is held fixedly by clamping means to be described hereinafter. In the non-tensioned starting position according to FIG. 7, in which the can 21 is inserted via opening 26 into the apparatus 23 and placed at the position shown in FIG. 7, the can is enclosed by a non-tensioned rubber cylindrical pressure jacket 27 onto which a substantially radially inward directed force can be exerted by a pressure medium 28 which can be admitted into pressure chamber 50 via aperture 29, which force, while deforming the rubber-like or rubber pressure jacket 27, subjects the can body 22 to a radial displacement which is so large that the can body is plastically deformed. The pressure exerted by pressure jacket 27 is designated symbolically with arrows 30.

In the non-tensioned state shown in FIG. 7 a piston 31 of a pressure cylinder 32 is situated in its position furthest to the left. It can have reached this through feed of pressure medium 33 via aperture 34. An aperture 35 on the other side of piston 31 serves in this embodiment to allow passage of medium to the other side of piston 31. Displaceable with piston 31 is a ring 36 which is connected via springs 37 to wedge segments 38. During the displacement of piston 31 to the right corresponding with the operating situation shown in FIG. 8, the wedge segments 38 are displaced to the right while a ring 39 is also moved to the right with corresponding radial inward displacement of segments 40 which are grouped in a ring. These segments are coupled for axial movement to a sleeve 41 connected to block 36. Segments 40 are thus expandable and together with a segmented ring 42 they can clampingly engage the mouth edge 10 of the can and thus fulfil the function of the second punch 11 as according to FIG. 2. It is noted in this respect that the end edges of segments 24 located furthest to the left exert the force 13 on the edge of the bottom 49. The segment ring 25 thus plays the part of the first punch 9 as according to FIG. 2.

A second cylinder 43 has an aperture 44 for feed of pressure medium 45, whereby a piston 46 can be displaced to the left. It is noted that cylinder 43 is itself guided slidably in ring 36. Due to the displacement of piston 46 to the left a cylinder 52 forming part of mandrel 48 moves to the left. The mandrel comprises the segments 25. The longitudinal tensile force can thus be applied according to the invention. The wedge-shaped segments 24 can be displaced by piston 31 via springs 47, segments 38 and springs 37.

The segments 38 are connected via springs 47 to segments 24. The structure of the expandable mandrel 48, i.e. the expandable structure placed in can 21, is, as will now be described with reference to FIG. 9, such that in the retracted situation according to FIG. 9 the mandrel 48 has a relatively small diameter which is smaller than the diameter of the mouth opening bounded by mouth edge 10.

In the situation shown in FIG. 10 the wedge segments 24 are displaced radially by axial displacement of piston 46, thus obtaining the shape with enlarged periphery as shown in FIG. 10. Since segments 25 have a concave, recessed shape which fits together with the convex shape of the peaks of segments 24, a structure can herewith be realized which corresponds with the annular grouping 3 of facets 5 according to FIG. 1. Attention is drawn to the fact that FIG. 10 shows the cross section through mandrel 28 at the level of this annular grouping 3.

After the can body 22 has been pressed with force by pressure jacket 27 against the outer surface of the mandrel 28 in the expanded state as according to FIG. 10, the shaping operation is completed and the pressure medium 28 can leave pressure jacket 27 via aperture 29. The axial force is simultaneously released by relieving the cylinder 43 through the pressure medium 45 leaving cylinder 43 via aperture 44 and pressure medium being supplied to the other side via aperture 51. the situation is then reached in which the apparatus is fully non-tensioned and the can has acquired the modelled shape according to FIG. 8 with the exception of a very slight elastic spring-back. The can may then be ejected by once again placing cylinder 43 under pressure via aperture 44. The movement to the left of piston 46 then results in ejection of the shaped can. This can may be removed from the retracted mandrel 48 of FIG. 9 with suitable means, for instance magnetic means.

It is generally recommended to make use for shaping of a can of a shaping surface. This is for instance the outer surface of mandrel 48 in the expanded situation of FIG. 10. Such shaping surfaces can particularly form part of a mandrel, a mould or the like.

The described axial auxiliary force according to the invention can act in the same direction as the naturally occurring shortening or elongating force, or have the opposing direction.

The shaped can of the invention as shown in FIG. 1 has two parts with the same diameter. These two parts can in particular have a cylindrical principal shape.

It is possible to start from a relatively small can and increase its size according to the teaching of the invention or start with a large can and reduce it in size by applying the invention.

The method according to the invention is not limited to only unprocessed cans consisting of metal but can also be applied to cans which have already been lacquered and/or provided with printing.

We claim:

1. A method for shaping a metal can comprising a substantially cylindrical body and a bottom such that the body acquires a cross-sectional form varying with the axial position, which method comprises the steps of:

(a) providing said can;

(b) exerting substantially radial forces on the body in the direction of the desired shaping; and (c) simultaneously and separately exerting a substantially axial tensile force on the body.

2. The method as claimed in claim 1, wherein the radial forces are directed outward.

3. The method as claimed in claim 2, wherein the axial force is exerted by mechanical means.

4. The method as claimed in claim 2, wherein the axial force is exerted by a pressurized fluid.

5. The method as claimed in claim 2, wherein the radial forces are exerted by mechanical means.

6. The method as claimed in claim 5, wherein mechanical means is at least one segmented pressure ring with variable diameter.

7. The method as claimed in claim 5, wherein mechanical means is a rubber press.

8. The method as claimed in claim 2, wherein the radial forces are exerted by a pressurized fluid.

9. The method as claimed in claim 1, wherein the radial forces press a can body toward and against a shaping wall, which wall has a shape corresponding with the desired final shape of the can body.

10. A method for shaping a metal can comprising a substantially cylindrical body and a bottom such that the body acquires a cross-sectional form varying with the axial position, which method comprises the steps of:

(a) providing said can;

(b) exerting substantially radially inward forces on the body in the direction of the desired shaping; and (c) simultaneously and separately exerting a substantially axial force on the body.

11. The method as claimed in claim 10, wherein the axial force is a tensile force.

12. The method as claimed in claim 10, wherein the axial force is exerted by a pressurized fluid.

13. The method as claimed in claim 10, wherein the radial forces are exerted by mechanical means.

14. The method as claimed in claim 13, wherein mechanical means is at least one segmented pressure ring with variable diameter.

15. The method as claimed in claim 13, wherein mechanical means is a rubber press.

16. The method as claimed in claim 10, wherein the radial forces are exerted by a pressurized fluid.

17. An apparatus for shaping a metal can comprising a substantially cylindrical body and a bottom such that the body acquires a cross-sectional form varying with the axial position, wherein the apparatus comprises:

(a) positioning means for positioning a can;

(b) first means for exerting substantially radial forces on the body of a positioned can in the direction of the desired shaping; and (c) second means for exerting a separate substantially axial tensile force on the can body simultaneously with the action of the first means.

* * * * *